US011230887B2

(12) United States Patent
Peters

(10) Patent No.: US 11,230,887 B2
(45) Date of Patent: Jan. 25, 2022

(54) ENCLOSED MODULE FOR A DOWNHOLE SYSTEM

(71) Applicant: Volker Peters, Wienhausen (DE)

(72) Inventor: Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 26 days.

(21) Appl. No.: 15/912,192

(22) Filed: Mar. 5, 2018

(65) Prior Publication Data

US 2019/0271193 A1 Sep. 5, 2019

(51) Int. Cl.

| | |
|---|---|
| ***E21B 7/06*** | (2006.01) |
| ***E21B 47/017*** | (2012.01) |
| ***E21B 17/10*** | (2006.01) |
| ***E21B 49/00*** | (2006.01) |
| ***E21B 47/14*** | (2006.01) |
| ***E21B 41/00*** | (2006.01) |
| ***E21B 47/13*** | (2012.01) |
| ***E21B 17/02*** | (2006.01) |
| ***E21B 47/024*** | (2006.01) |
| *E21B 47/12* | (2012.01) |

(52) U.S. Cl.

CPC ..... *E21B 7/062* (2013.01); *E21B 7/067* (2013.01); *E21B 17/028* (2013.01); *E21B 17/1014* (2013.01); *E21B 41/0085* (2013.01); *E21B 47/017* (2020.05); *E21B 47/024* (2013.01); *E21B 47/13* (2020.05); *E21B 47/14* (2013.01); *E21B 49/00* (2013.01); *E21B 47/12* (2013.01)

(58) Field of Classification Search

CPC .... E21B 7/067; E21B 41/0085; E21B 47/011; E21B 47/024; E21B 47/122; E21B 47/14; E21B 49/00; E21B 47/13; E21B 47/017; E21B 17/028; E21B 47/12; E21B 17/1014; E21B 7/062; E21B 17/05; E21B 17/10

See application file for complete search history.

(56) References Cited

U.S. PATENT DOCUMENTS 5,931,239 A 8/1999 Schuh
6,092,610 A 7/2000 Kosmala et al.
(Continued)

FOREIGN PATENT DOCUMENTS

WO WO2012036927 A1 3/2012

OTHER PUBLICATIONS

International Search Report and Written Opinion for International Application No. PCT/US2019/020485; International Filing Date Mar. 4, 2019; Report dated Jun. 14, 2019 (pp. 1-9).
(Continued)

*Primary Examiner* — Nicole Coy
(74) *Attorney, Agent, or Firm* — Cantor Colburn LLP

(57) ABSTRACT

A device for steering a drilling assembly including a sleeve configured to be disposed around a length of a drive shaft configured to be disposed in a borehole in an earth formation. The drive shaft is configured to be rotated. The sleeve is configured to be rotationally decoupled from the drive shaft. Two or more modules are configured to be removably connected to the sleeve. Each of the two or more modules at least partially encloses a biasing element configured to be actuated to control a direction of the drilling assembly. Each of the two or more modules at least partially encloses a communication device for wireless communication.

19 Claims, 12 Drawing Sheets

(56) References Cited

U.S. PATENT DOCUMENTS

| | | | | |
|---|---|---|---|---|
| 6,109,372 | A | 8/2000 | Dorel et al. | |
| 6,158,529 | A | 12/2000 | Dorel | |
| 6,427,783 | B2 * | 8/2002 | Krueger | E21B 7/062 175/40 |
| 6,439,325 | B1 | 8/2002 | Peters et al. | |
| 6,540,032 | B1 | 4/2003 | Krueger | |
| 6,837,314 | B2 * | 1/2005 | Krueger | E21B 7/06 175/59 |
| 6,913,095 | B2 | 7/2005 | Krueger | |
| 7,267,184 | B2 * | 9/2007 | Helms | E21B 7/062 175/24 |
| 7,828,066 | B2 | 11/2010 | Jahn | |
| 8,179,278 | B2 | 5/2012 | Shakra et al. | |
| 8,550,186 | B2 | 10/2013 | Deolalikar et al. | |
| 8,567,524 | B2 | 10/2013 | Schimanski et al. | |
| 8,720,608 | B2 | 5/2014 | Downton et al. | |
| 8,890,341 | B2 | 11/2014 | Ocalan et al. | |
| 9,016,401 | B2 * | 4/2015 | Savage | E21B 47/02 175/73 |
| 9,260,961 | B2 | 2/2016 | Miller et al. | |
| 9,371,728 | B2 | 6/2016 | Jacob et al. | |
| 9,506,335 | B1 | 11/2016 | Smith | |
| 9,702,194 | B1 | 7/2017 | Hogan | |
| 10,156,136 | B2 | 12/2018 | Gooneratne et al. | |
| 2004/0256162 | A1 * | 12/2004 | Helms | E21B 7/062 175/325.2 |
| 2009/0173493 | A1 | 7/2009 | Hutin et al. | |
| 2010/0108382 | A1 | 5/2010 | Ma et al. | |
| 2010/0200295 | A1 | 8/2010 | Schimanski et al. | |
| 2014/0190750 | A1 | 7/2014 | Samuel | |
| 2014/0262507 | A1 | 9/2014 | Marson et al. | |
| 2015/0252666 | A1 | 9/2015 | Wang et al. | |
| 2015/0337644 | A1 | 11/2015 | Mueller et al. | |
| 2016/0177703 | A1 | 6/2016 | Richards | |
| 2016/0194952 | A1 | 7/2016 | Switzer et al. | |
| 2016/0362937 | A1 | 12/2016 | Dyer et al. | |
| 2017/0044834 | A1 * | 2/2017 | Peters | E21B 10/322 |
| 2017/0275984 | A1 | 9/2017 | Wang et al. | |
| 2019/0145177 | A1 * | 5/2019 | Peters | E21B 10/322 |
| 2019/0153852 | A1 | 5/2019 | Lallemand et al. | |
| 2019/0271227 | A1 | 9/2019 | Peters | |

OTHER PUBLICATIONS

International Search Report and Written Opinion for International Application No. PCT/US2019/020486; International Filing Date Mar. 4, 2019; Report dated Jun. 19, 20419 (pp. 1-11).

* cited by examiner

ENCLOSED MODULE FOR A DOWNHOLE SYSTEM

BACKGROUND

Directional drilling is commonly employed in hydrocarbon exploration and production operations. Directional drilling is typically accomplished using sensor modules and/or steering assemblies that act to change the direction of a drill bit. One type of directional drilling assembly involves a so-called "non-rotating sleeve" that includes devices for generating forces against a borehole wall or devices that bend a drive shaft passing through the non-rotating sleeve. In such applications, the non-rotating sleeve is typically supported by bearings that allow the sleeve to remain relatively stationary with respect to the earth formation. The stationary position of the sleeve allows for the application of relatively stationary forces to the borehole wall to create a steering direction.

SUMMARY

Disclosed is a device for steering a drilling assembly including a sleeve configured to be disposed around a length of a drive shaft configured to be disposed in a borehole in an earth formation. The drive shaft is configured to be rotated. The sleeve is configured to be rotationally decoupled from the drive shaft. Two or more modules are configured to be removably connected to the sleeve. Each of the two or more modules at least partially encloses a biasing element configured to be actuated to control a direction of the drilling assembly. Each of the two or more modules at least partially encloses a communication device for wireless communication.

A method of steering a drilling assembly includes disposing the drilling assembly in an earth formation. The drilling assembly includes a sleeve configured to be disposed around a length of a drive shaft. The sleeve is configured to be rotationally decoupled from the drive shaft. Two or more modules are removably connected to the sleeve. Each of the two or more modules at least partially encloses a biasing element and a communication device for wireless communication. The method further includes communicating, with the communication device at each of the two or more modules, and actuating the biasing element in at least one of the two or more modules to control a direction of the drilling assembly.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Apparatuses, systems and methods for directional drilling through a formation are described herein. An embodiment of a directional drilling device or system includes a self-contained module configured to be incorporated in a downhole component that may include a substantially non-rotating sleeve. The module is hermetically sealed and is modular, i.e., the self-contained module may be easily exchanged for other modules to reduce turn-around time. In accordance with an exemplary aspect, the self-contained module can be installed on and/or removed from the downhole component or the substantially non-rotating sleeve without having to electrically disconnect the module or otherwise impact other components of the system such as the downhole component, the directional drilling device, the substantially non-rotating sleeve and/or a steering system. To that end, in one embodiment, the self-contained module includes a wireless communication capability to allow components of the self-contained module to be operated without requiring any physical electrical connection, such as a connector, between the self-contained module and other components, such as the substantially non-rotating sleeve, a steering system, or a measurement tool.

The self-contained module houses and at least partially encloses or encapsulates one or more of a variety of components to facilitate or perform functions such as steering, communication, measurement and/or others. In one embodiment, the self-contained module houses and at least partially encloses a biasing device (e.g. a cylinder and piston assembly) that can be actuated to affect changes in drilling direction. The self-contained module may include an energy storage device (e.g., a battery, a rechargeable battery, a capacitor, a supercapacitor or a fuel cell). In one embodiment, the self-contained module may house an energy transmitting/receiving device configured to supply energy, such as electrical energy to components in the module. The energy transmitting/receiving device may generate electricity, e.g. via inductive coupling with a magnetic field generated due to rotation of a drive shaft or other component of a drill string.

Figure 1:
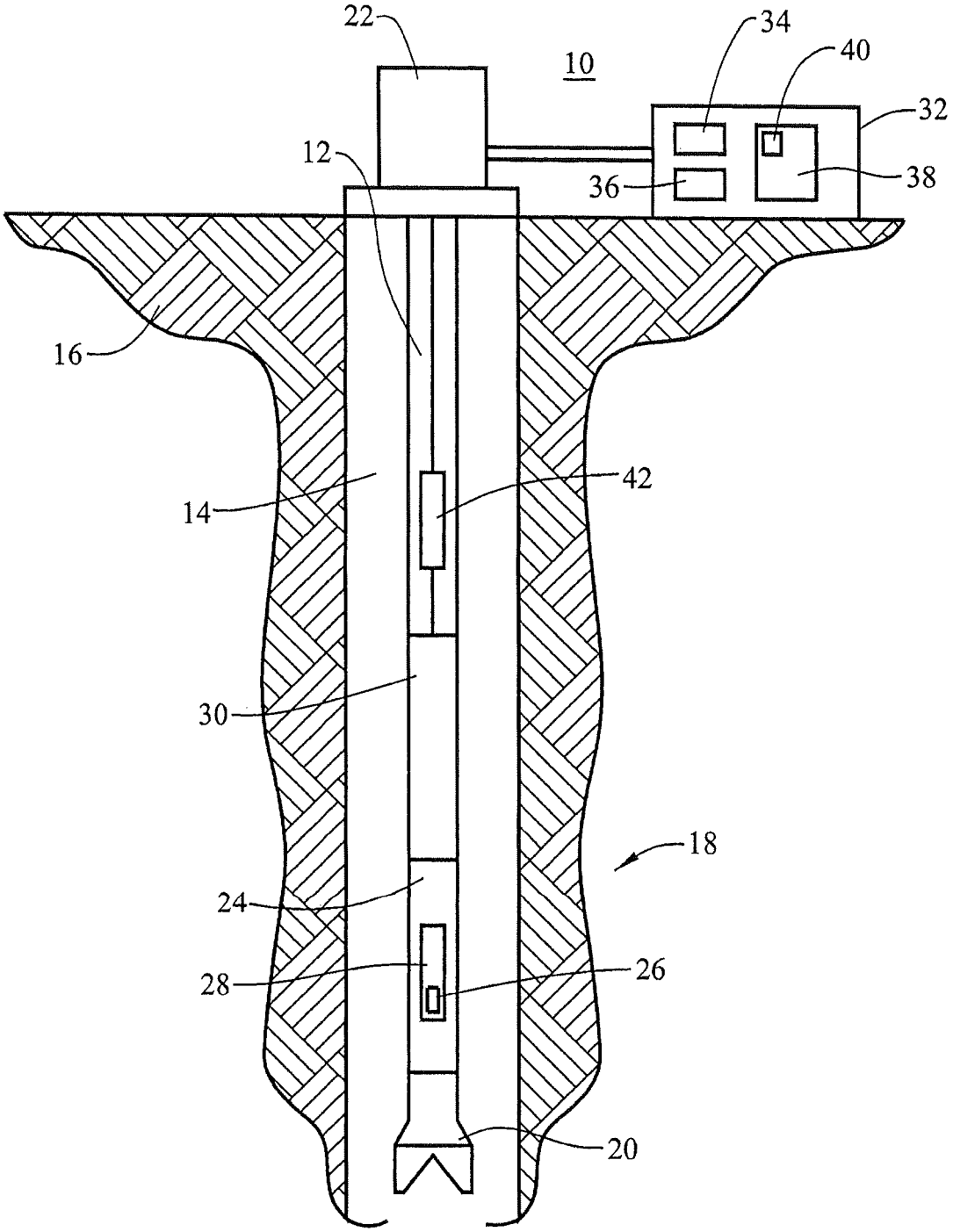
FIG. 1 depicts an embodiment of a drilling and/or measurement system.

FIG. 1 illustrates an exemplary embodiment of a well drilling, exploration, productions, measurement (e.g., logging) and/or geosteering system 10, which includes a drill string 12 configured to be disposed in a borehole 14 that penetrates an earth formation 16. Although the borehole 14 is shown in FIG. 1 to be of constant diameter and direction, the borehole is not so limited. For example, the borehole 14 may be of varying diameter and/or direction (e.g., azimuth and inclination). The drill string 12 is made from, for example, a pipe, multiple pipe sections or coiled tubing. The system 10 and/or the drill string 12 includes a drilling assembly (including, e.g., a drill bit 20 and steering assembly 24) and may include various other downhole components or assemblies, such as measurement tools 30 and communication assemblies, one or more of which may be collectively called a bottomhole assembly (BHA) 18. Measurement tools may be included for performing measurement regimes such as logging-while-drilling (LWD) applications and measurement-while-drilling (MWD) applications. Sensors may be disposed at one or multiple locations along a borehole string, e.g., in the BHA 18, in the drill string 12, in measurement tool 30, such as a logging sonde, or as distributed sensors.

The drill string 12 drives a drill bit 20 that penetrates the earth formation 16. Downhole drilling fluid, such as drilling mud, is pumped through a surface assembly 22 (including, e.g., a derrick, rotary table or top drive, a coiled tubing drum and/or standpipe), the drill string 12, and the drill bit 20 using one or more pumps, and returns to the surface through the borehole 14.

Steering assembly 24 includes components configured to steering the drill bit 20. In one embodiment, steering assembly 24 includes one or more biasing elements 26 configured to be actuated to apply lateral force to the drill bit 20 to accomplish changes in direction. One or more biasing elements 26 may be housed in a module 28 that can be removably attached to a sleeve (not separately labeled) in the steering assembly 24.

Various types of sensors or sensing devices may be incorporated in the system and/or drill string. For example, sensors such as magnetometers, gravimeters, accelerometers, gyroscopic sensors and other directional and/or location sensors can be incorporated into steering assembly 24 or in a separate component. Various other sensors can be incorporated into the steering assembly and/or in a measurement tool 30. Examples of measurement tools include resistivity tools, gamma ray tools, density tools, or calipers.

Other examples of devices that can be used to perform measurements include temperature or pressure measurement tools, pulsed neutron tools, acoustic tools, nuclear magnetic resonance tools, seismic data acquisition tools, acoustic impedance tools, formation pressure testing tools, fluid sampling and/or analysis tools, coring tools, tools to measure operational data, such as vibration related data, e.g. acceleration, vibration, weight, such as weight-on-bit, torque, such as torque-on-bit, rate of penetration, depth, time, rotational velocity, bending, stress, strain, any combination of these, and/or any other type of sensor or device capable of providing information regarding formation 16, borehole 14 and/or operation.

Other types of sensors may include discrete sensors (e.g., strain and/or temperature sensors) along the drill string or sensor systems comprising one or more transmitter, receiver, or transceivers at some distance, as well as distributed sensor systems with various discrete sensors or sensor systems distributed along the system 10. It is noted that the number and type of sensors described herein are exemplary and not intended to be limiting, as any suitable type and configuration of sensors can be employed to measure properties.

A processing unit 32 is connected in operable communication with components of the system 10 and may be located, for example, at a surface location. The processing unit 32 may also be incorporated at least partially in the drill string 12 or the BHA 18 as part of downhole electronics 42, or otherwise disposed downhole as desired. Components of the drill string 12 may be connected to the processing unit 32 via any suitable communication regime, such as mud pulse telemetry, electro-magnetic telemetry, acoustic telemetry, wired links (e.g., hard wired drill pipe or coiled tubing), wireless links, optical links or others. The processing unit 32 may be configured to perform functions such as controlling drilling and steering, transmitting and receiving data (e.g., to and from the BHA 18 and/or the module 28), processing measurement data and/or monitoring operations. The processing unit 32, in one embodiment, includes a processor 34, a communication and/or detection member 36 for communicating with downhole components, and a data storage device (or a computer-readable medium) 38 for storing data, models and/or computer programs or software 40. Other processing units may comprise two or more processing units at different locations in system 10, wherein each of the processing units comprise at least one of a processor, a communication device, and a data storage device.

Figure 2:
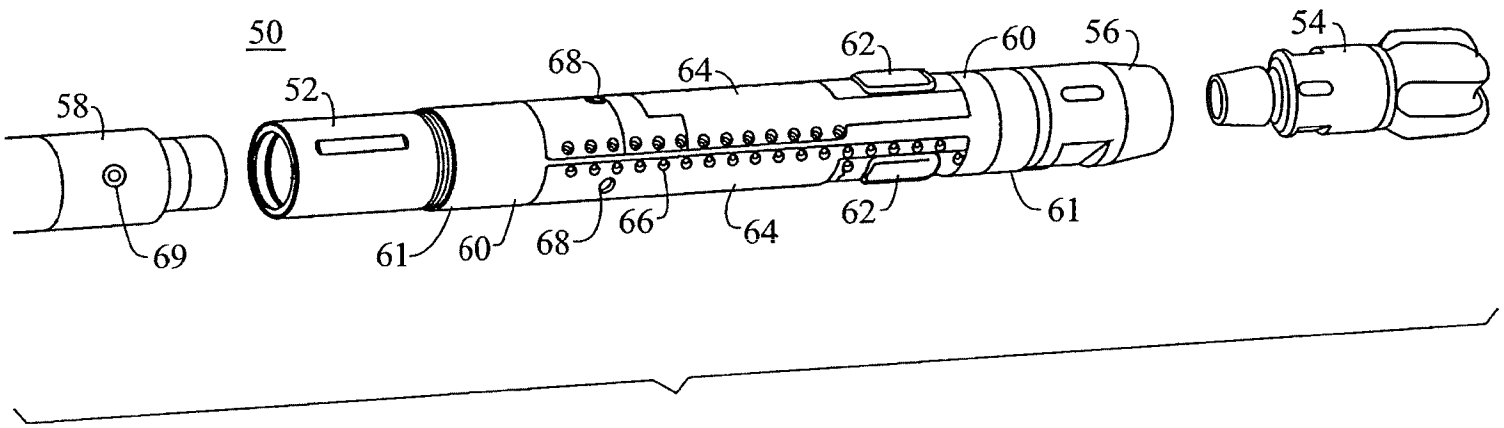
FIG. 2 depicts an embodiment of a steering assembly for a drilling system, which includes a module mounted on a non-rotating sleeve.
Figure 3:
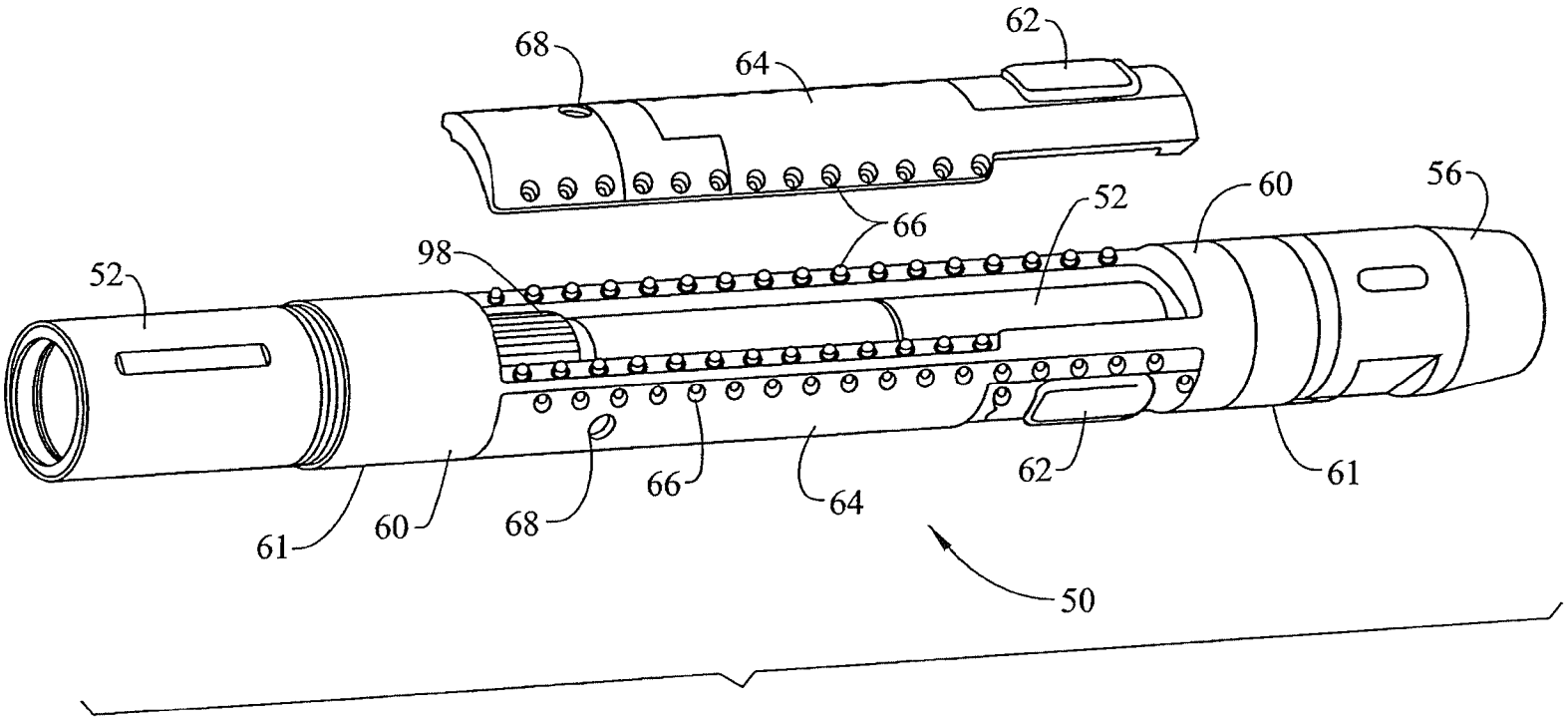
FIG. 3 depicts the steering assembly of FIG. 2 with the module removed from the non-rotating sleeve.

FIGS. 2 and 3 illustrate an embodiment of a steering assembly 50 for use in directional drilling. The steering assembly 50 may be incorporated into the system 10 (e.g., in BHA 18) or may be part of any other system configured to perform drilling operations. The steering assembly 50 includes a drive shaft 52 configured to be rotated from the surface, e.g. by a top drive (not shown), that may be part of surface assembly 22, or downhole (e.g., by a mud motor or turbine (also not shown) that may be part of the BHA 18. The drive shaft 52 can be connected at one end to a disintegrating device, such as a drill bit 54 via, e.g., a bit box connector 56. The disintegrating device, in combination with or in place of the drill bit 54, may include any other device suitable for disintegrating the rock formation, including, but not limited to, an electric impulse device (also referred to as electrical discharge device), a jet drilling device, or a percussion hammer.

The drive shaft 52 can be connected at the other end and/or at the same end between the disintegrating tool and the drive shaft 52 to a downhole component 58, such as measurement tool 30, a mud motor (not shown), a communication tool to provide communication from and to surface assembly 22, a power generator (not shown) that generates power downhole for driving other tools in the BHA 18, such as the downhole electronics, 42, the measurement tool 30 including sensors, such as formation evaluation sensors, or operational sensors, a reamer (e.g. an underreamer, not shown) the steering assembly 24, 50, or a pipe section in drill string 12, via a suitable string connection such as a pin-box connection. Some of the downhole components 58, such as measurement tools, may benefit from the close position to the disintegrating device when connected at the lower end of drive shaft 52 between disintegrating device and the steering assembly 50.

The steering assembly 50 also includes a sleeve 60 that surrounds a portion of the drive shaft 52. The sleeve 60 may include one or more biasing elements 62 that can be actuated to control the direction of the drill bit 54 and the drill string 12. Examples of biasing elements include devices such as cylinders, pistons, wedge elements, hydraulic pillows, expandable rib elements, blades, and others.

The sleeve 60 is mounted on the drive shaft via bearings 61 or another suitable mechanism so that the sleeve 60 is to at least some extent rotationally de-coupled from the drive shaft 52 or other rotating components. For example, the sleeve 60 is connected to bearings 61, e.g. mud lubricated bearings, that may be any type of bearings including but not limited to contact bearings, such as sliding contact bearings or rolling contact bearings, journal bearings, ball bearings or bushings. The sleeve 60 may be referred to as a "non-rotating sleeve", or "slowly rotating sleeve" which is defined as a sleeve or other component that is to at least some extent rotationally decoupled from rotating components of the steering assembly 50. During drilling, the sleeve 60 may not be completely stationary, but may rotate at a lower rotational speed compared to the drive shaft 52 due to the friction between sleeve 60 and drive shaft 52, e.g., friction that is generated by bearings 61. The sleeve 60 may have slow or no rotational movement compared to the drive shaft 52 (e.g., when biasing elements 62 are engaged with a borehole wall), or may rotate independent of the drive shaft 52 (usually the sleeve 60 rotates at a much lower rate than the drive shaft 52) especially when the biasing elements 62 are actively engaged.

For example, while drive shaft 52 may rotate between about 100 to about 600 revolutions per minute (r.p.m.), the sleeve 60 may rotate at less than about 2 r.p.m. Thus, the sleeve 60 is substantially non-rotating with respect to the drive shaft 52 and is, therefore, referred to herein as the substantially non-rotating or non-rotating sleeve, irrespective of its actual rotating speed. In some instances, the biasing elements 62 can be supported by spring elements (not shown), such as a coil spring, or a spring washer, e.g. a conical spring washer to engage with the formation even when the biasing elements 62 are not actively powered.

In one embodiment, the biasing element 62 (or elements) is configured to engage the borehole wall and provide a lateral force component to the drive shaft 52 through the bearings 61 to cause the drive shaft 52 and the drill bit 54 to change direction. One or more biasing elements 62 are connected to the non-rotating sleeve 60 to apply relatively stationary forces to the borehole wall (also referred to as "pushing the bit") or to deflect the drive shaft 52, causing the bend direction of the rotating drive shaft 52 to create a steering direction (also referred to as "pointing the bit").

Since the non-rotating sleeve 60 rotates significantly slower or does not rotate at all with respect to the formation 16, the biasing elements 62, and thus, the forces applied to the borehole wall have a direction that varies relatively slowly compared to the faster rotation of the drive shaft 52. This allows for a force applied to the borehole wall to keep a desired steering direction with much less variation compared to a scenario where the biasing element 62 rotates with the drive shaft 52. In this manner, the power required to achieve and/or keep a desired steering direction significantly lower as compared to a system in which the biasing element 62 rotates with the drive shaft 52. Thus, utilization of the non-rotating sleeve 60 allows for operation of steering systems with relatively low power demand.

The sleeve 60 may be a modular component of the steering assembly 50. In aspects, the sleeve 60 can be installed on and removed from the steering assembly 50 without having to electrically disconnect the sleeve or otherwise impact other components of the steering system. In addition, the sleeve 60 also includes one or more modules 64 configured to enclose or house one or more components for facilitating steering functions. Each module 64 is mechanically and electrically self-contained and modular, in that the module 64 can be attached to and removed from the sleeve 60 without affecting components in the module 64 or steering assembly 50.

For example, each module 64 includes mechanical attachment features such as clamping elements (not shown), e.g. devices for thermal clamping, devices including shape memory alloy, press fit devices, or tapered fit devices, or screw holes 66 that allow the module 64 to be fixedly connected to the sleeve 60 with a removable fixing mechanism such as screws, bolts, threads, magnets, or clamping elements, e.g. mechanical clamping elements, thermal clamping elements, clamping elements including shape memory alloy, press fit elements, tapered fit elements, and/or any combination thereof. Further, in another example, module 64 may be fixedly connected to the sleeve 60 with removable fixing mechanism such as screws, bolts, threads, magnets, or clamping elements, e.g. mechanical clamping elements, thermal clamping elements, clamping elements including shape memory alloy, press fit elements, tapered fit elements, or any combination thereof without any non-removable fixing elements.

Each module 64 may at least partially enclose one or more biasing elements 62, and may include one type of biasing element 62 or multiple types of biasing elements 62. It is noted that each module 64 can include a respective biasing element 62 and associated controller, allowing each biasing element 62 to be operated independently.

In the embodiment of FIGS. 2 and 3, the sleeve 60 includes three modules 64 circumferentially arranged (e.g., separated by the same angular distance). However, the sleeve 60 is not so limited and can include a single module 64 or any suitable number of modules 64. Also, the module or modules 64 can be positioned at any suitable location or configuration.

Each module 64 and/or the sleeve 60 may include sealing components to allow for hermetically sealing the module 64 to the sleeve 60 so as to prevent fluid from flowing through the wall of the sleeve 60. Alternatively, the module 64 may be attached to the sleeve 60 without sealing the module 64 to the sleeve 60, e.g. without any fluid sealing elements beyond the mechanical attachment discussed above.

In one embodiment, each module 64 is configured to communicate with components outside of the module 64 without a physical electrical connection, such as a wire or cable. The module 64 can thus be installed and removed without having to connect or disconnect any electrical or other connections besides the mechanical attachment. For example, as shown in FIGS. 2 and 3, each module 64 can be equipped with an antenna 68 and suitable electronics to transmit and receive signals to and from one or more antennas 69 at other components of the drill string or antennas 68 on one or more of the modules 64.

The modules 64 can therefore be handled as enclosed units, even when they are detached from the sleeve 60. Thus, as the modules 64 may be hermetically enclosed units, they can, for instance, be tested, verified, calibrated, maintained, and/or repaired, or it can exchange data (download or upload), without the need to attach the modules 64 to the sleeve 60, or simply be cleaned, e.g. by using a regular high pressure washer. The modules 64 may further be exchanged when not working properly to quickly repair the steering assembly 50 during or in preparation of a drilling job. That is, modules 64 may be exchanged by accessing the BHA 18 or steering assembly 24 from the outer periphery of the BHA 18 or steering assembly 24. This allows to exchange modules 64 without breaking string connections.

In particular, module 64 may be exchanged without disconnecting the string connections at the upper and/or lower end of the steering assembly and without disassembling the steering assembly 24 from the BHA 18 or drill string 12. In particular, module 64 may be exchanged while the steering assembly 24 is connected, e.g. mechanically connected to at least a part of the BHA 18 or drill string 12 via one or more drill string connections. Exchanged modules may be sent to an offsite repair and maintenance facility for further investigation and maintenance without the need to ship the steering assembly 50 or to disconnect the steering assembly 50 from at least a part of the BHA 18 or drill string 12. That is, testing, verification, calibration, data transfer (upload or download data), maintenance, and repair can be done on a module level rather than on a tool level. This allows for a quick exchange of modules to repair assemblies and to ship relatively small modules rather than complete downhole drilling tools.

In addition, exemplary embodiments allows for a quick exchange of modules from an outer periphery of steering assembly 24 to affect a repair while the steering assembly 24 is still physically connected to the BHA 18 and/or the drill string 12. The capability for a quick exchange of modules to repair steering assembly 24 and the option to ship relatively small modules rather than complete downhole drilling tools and/or the capability for a quick exchange of modules to repair assemblies while the steering assembly 24 is still physically connected to the BHA 18 and/or drill string 12, for example via the string connector, is a major benefit that facilitates a significant reduction in operational cost.

As noted, one or more of modules 64 may be configured to communicate wirelessly with a communication device, such as an antenna 69 and/or an inductive coupling device at a component such as a pipe segment, BHA 18, the drill bit 20, the drive shaft 52 or other downhole component 58 or another module in another component. While the invention is described herein with respect to antennas, it is to be understood that the antennas may also be inductive coupling devices, electromagnetic coupling devices, electromagnetic resonant coupling devices, acoustic coupling devices, and/or combinations thereof, or other means for wireless communication known in the art. In accordance with an exemplary aspect, any suitable method or protocol of transferring data may be utilized, including, but not limited to, Bluetooth, ZigBee, LoRA, Wireless LAN, DECT, GSM, UWB and UMTS, at any suitable frequency, such as a frequency between 500 Hz to 100 GHz. Wireless communication between rotating and non-rotating parts of a downhole drilling tool, such as a steering tool, are described, for example, in US20100200295 and U.S. Pat. No. 6,540,032, both of which incorporated herein by reference in their entirety.

While the antennas 68 to communicate from and to the modules 64 are shown to be located at the outer periphery of modules 64, they can also be installed at other locations, such as but not limited to, the inside, e.g. the inner surface of the modules 64 or an end wall of module 64. Location of the communication device, such as antennas 68 at the inner surface may facilitate the communication to the drive shaft 52, when the antenna 69 is installed on the drive shaft 52, e.g. close to or within sleeve 60, and when the antenna 68 is at a relatively low distance to the antenna 69 in or on the drive shaft 52, e.g. when the antenna 68 slides over antenna 69 when the steering assembly 50 is assembled. One or more of modules 64 may also be configured to communicate with other modules 64 on the sleeve 60, e.g., to coordinate actuation of biasing elements 62. For example, each module 64 provides a communication interface to communicate at least partially wirelessly with other modules 64 and/or to other sections of the BHA 18.

Communication between the modules 64 may also be performed via a communication module (not shown) within the drive shaft 52, the non-rotating sleeve 60, one of the modules 64, or any other downhole component 58 that receives information from one of the modules 64 and transmits the same, or a processed, amplified, or otherwise modified information, or a different information to at least one of the other modules 64. In accordance with an exemplary aspect, the communication module may also be utilized for the communication between modules 64 and between modules and other downhole components. A communication interface and/or module may be powered by an energy storage device in the module 64 (e.g., a battery, a rechargeable battery, a capacitor, a supercapacitor, or a fuel cell) and/or by an energy receiving device in the non-rotating sleeve 60 or the module 64 that may receive energy from inside the steering assembly 50. For example, the energy receiving device may receive energy in the module 64 from an external power source such as an inductive power device within the drive shaft 52. One embodiment of an inductive power device is an inductive transformer. Other embodiments of the inductive power device are discussed further below.

Figure 4A:
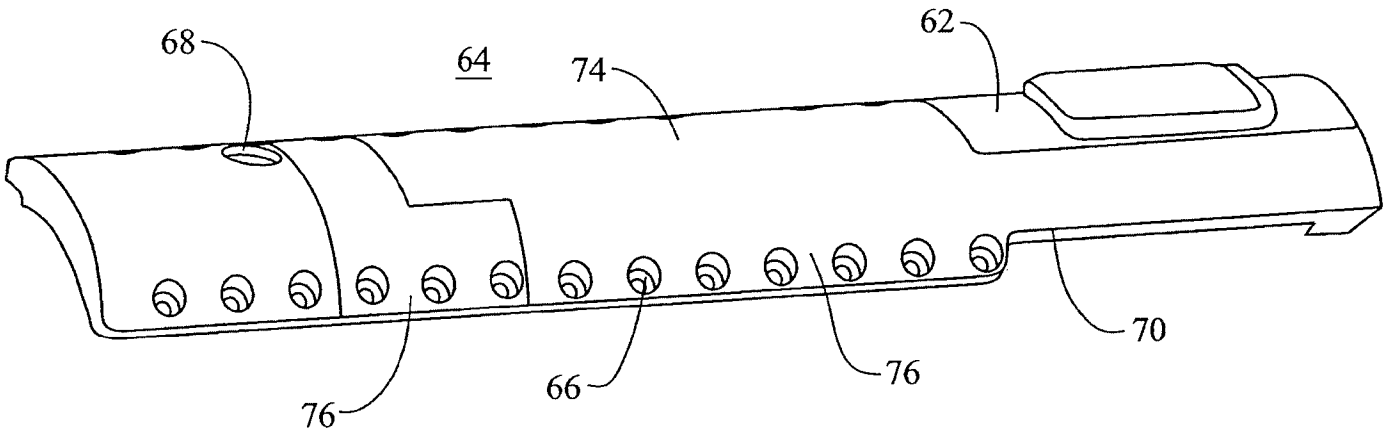
FIGS. 4A and 4B are perspective views of a module configured to be incorporated in a steering system.
Figure 4B:
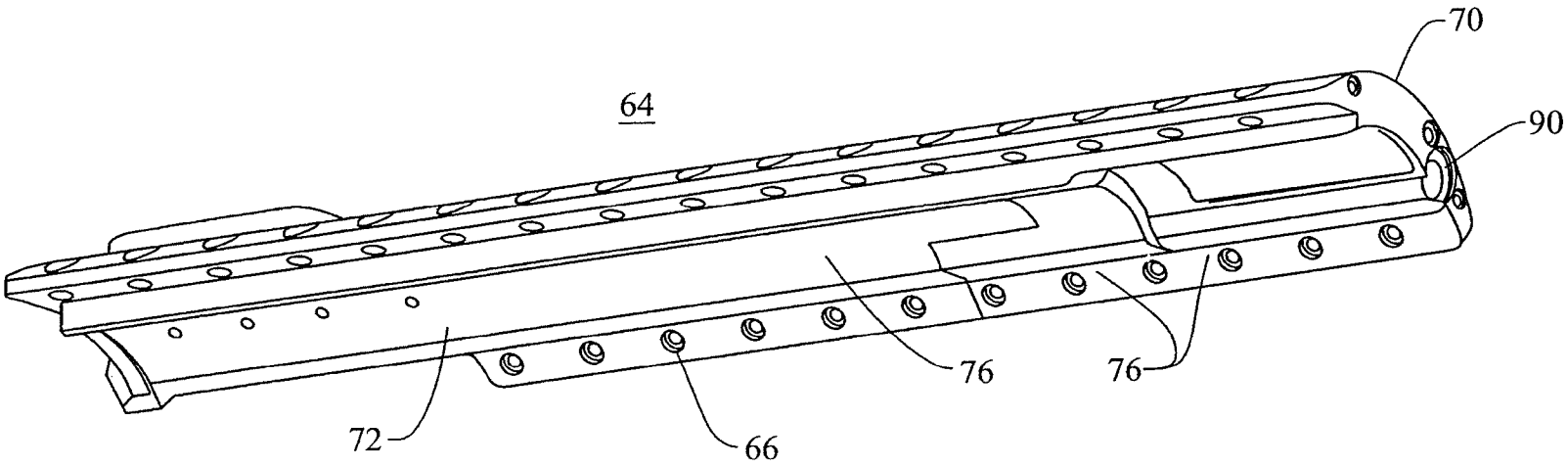

FIGS. 4A and 4B show perspective views of module 64. As shown, in one embodiment, the module 64 includes a housing 70 that has a shape configured to be removably attached (e.g., via screws, bolts, threads, magnets, or clamping elements, e.g. mechanical clamping elements, thermal clamping elements, clamping elements including shape memory alloy, press fit elements, tapered fit elements, or any combination thereof) to a correspondingly shaped cutout (not separately labeled) in the wall of the sleeve 60. The module 64 may have a thickness equal to or similar to the thickness of the sleeve 60, and thereby form part of the wall. Alternatively, the module 64 may have a thickness that is less than the thickness of the sleeve 60, and can be mounted at a recess (not separately labeled) formed in the sleeve wall. The thickness of the module 64 may be sized to house the various parts and components included in the module 64 as discussed further below. The module 64 may also be curved so as to conform to the curvature of the sleeve 60, which is typically cylindrical. Optionally, module 64 may be covered by a hatch cover (not separately labeled).

The housing 70 may be an integral part that is accessible via openings, such as open holes or ports may also include a number of housing components, such as a lower housing component 72, which can be a single integral housing component or have multiple housing components. An upper housing component 74 may also be a single integral housing component or have multiple housing components, and can be attached to the lower housing component 72 via a permanent joining (e.g., by welding, gluing, brazing, adhesive attachment) or a removable joining (e.g., screws, bolts, threads, magnets, or clamping elements, e.g. mechanical clamping elements, thermal clamping elements, clamping elements including shape memory alloy, press fit elements, tapered fit elements, or any combination thereof). It is noted that the terms "upper" and "lower" are not intended to prescribe any particular orientation of the module 64 with respect to, e.g., a drill string, sleeve or borehole.

As shown in FIGS. 4A and 4B, the housing 70, lower housing component 72 and/or upper housing component 74 can be made from multiple sections 76. For example, the housing 70 is divided into multiple sections 76 that can house different components and can be removably (such as by screws, bolts, threads, magnets, or clamping elements, e.g. mechanical clamping elements, thermal clamping elements, clamping elements including shape memory alloy, press fit elements, tapered fit elements, or any combination thereof) or permanently (such as by welding, gluing, brazing, or adhesive attachment) joined together.

Figure 5:
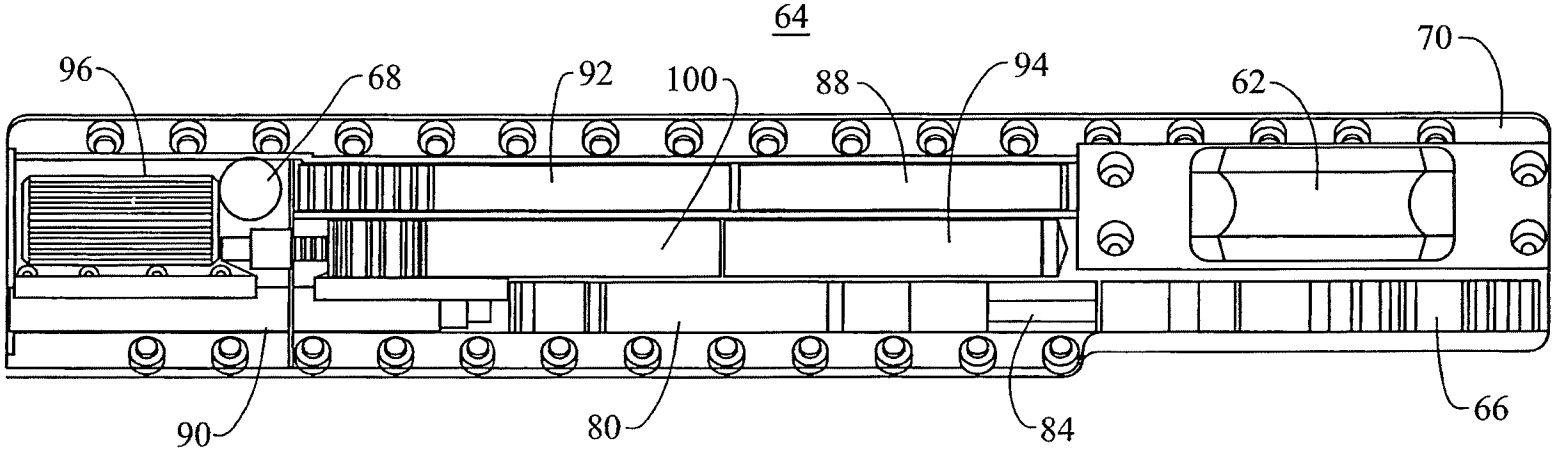
FIG. 5 is an internal view of the module of FIGS. 4A and 4B.
Figure 6:
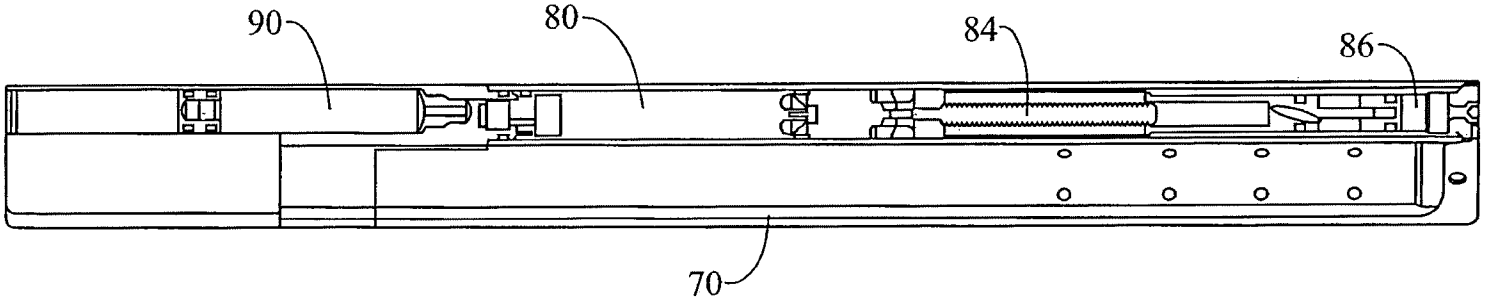
FIG. 6 is a cross-sectional view of the module of FIGS. 4A and 4B.
Figure 7:
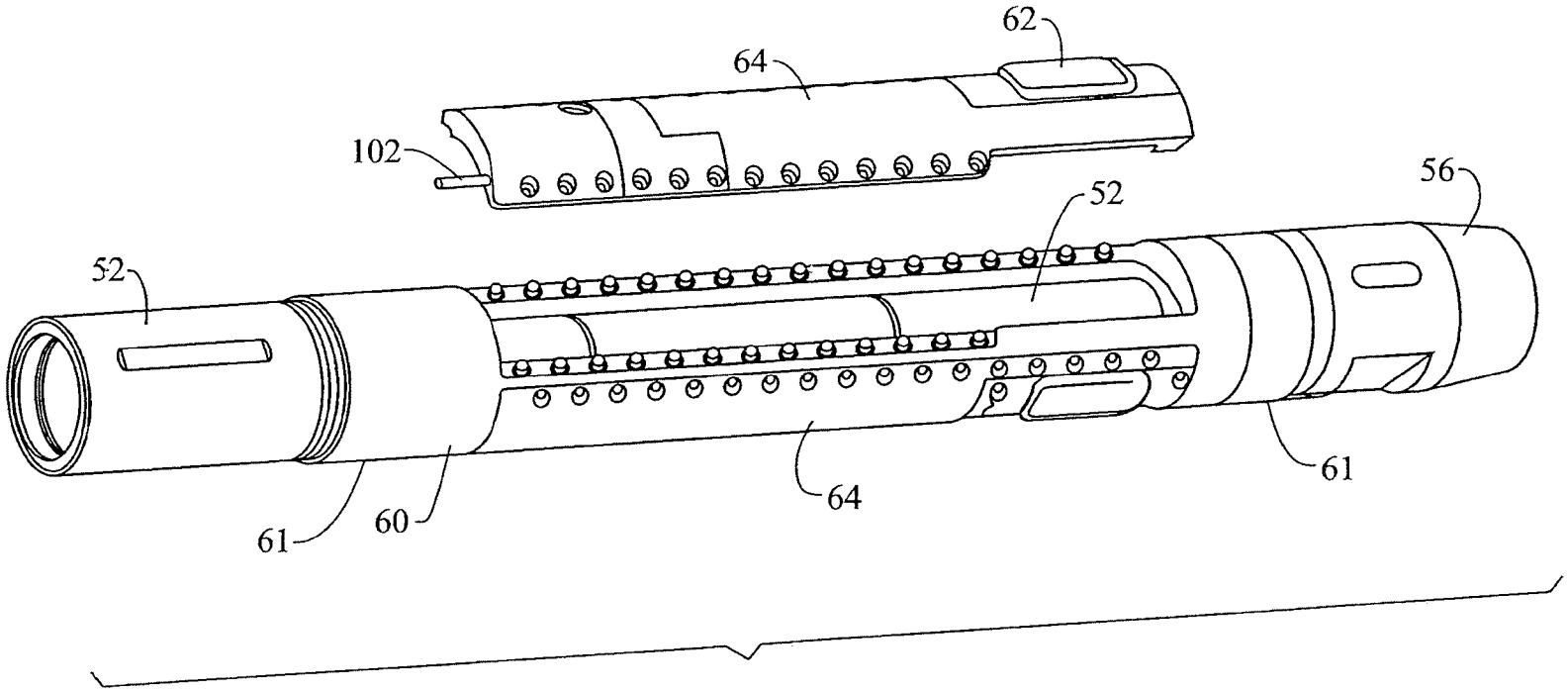
FIG. 7 depicts an embodiment of a steering assembly for a drilling system, which includes a module mounted on a non-rotating sleeve and an energy transmitting/receiving device.
Figure 8:
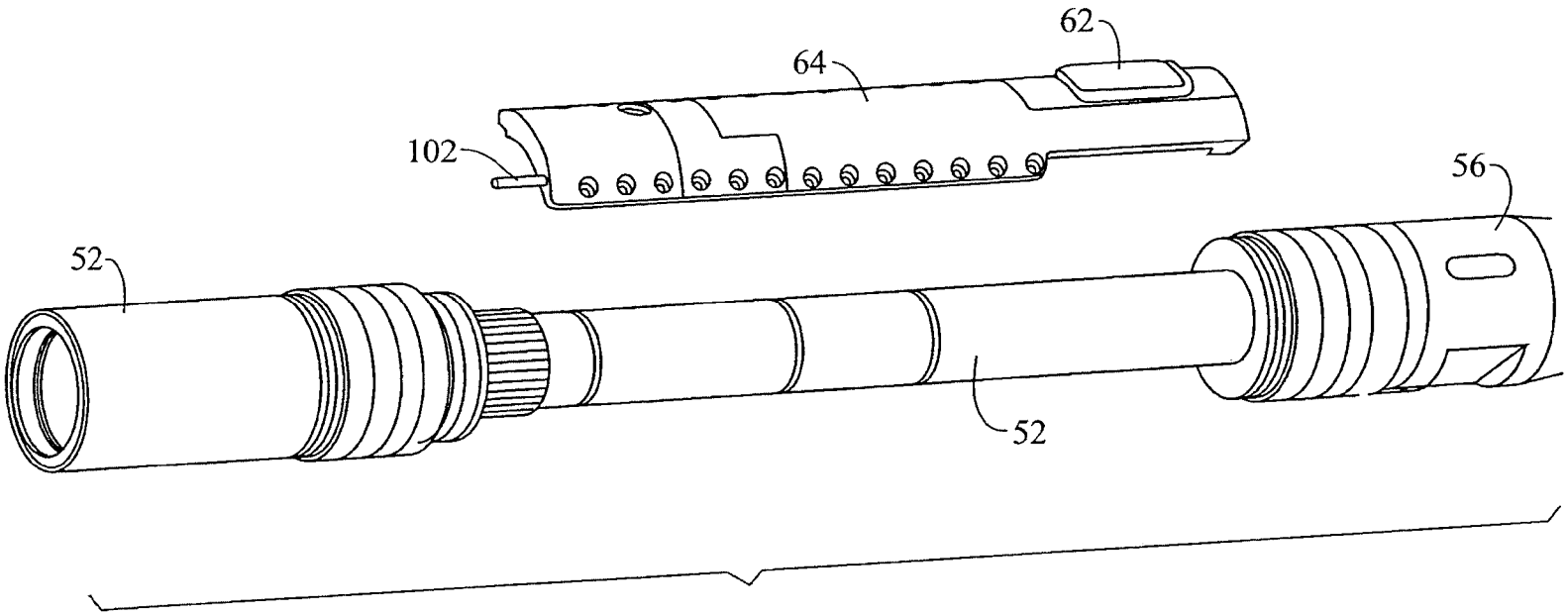
FIG. 8 is perspective view of the module of the steering assembly of FIG. 7.
Figure 9:
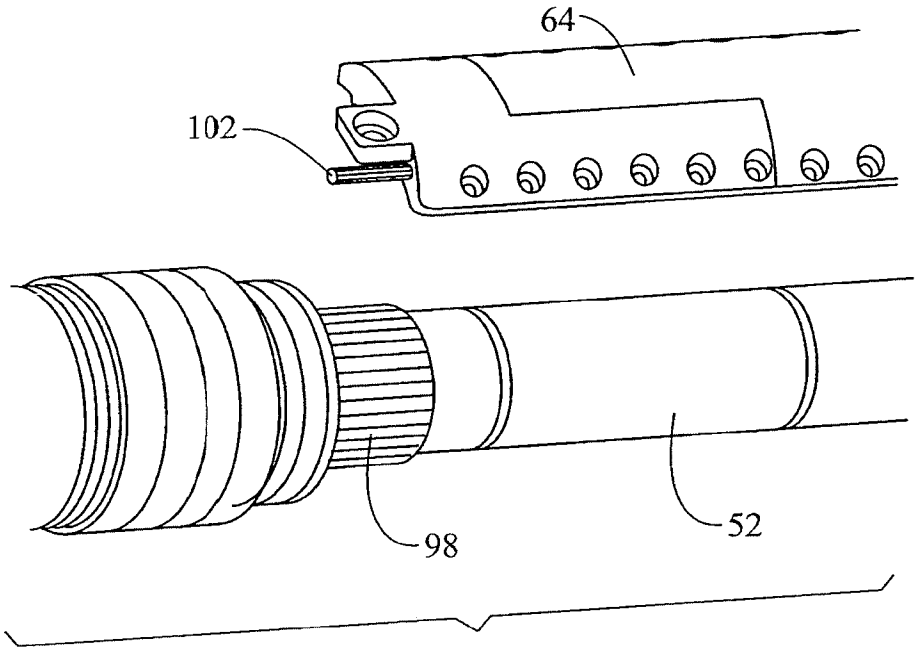
FIG. 9 is a close up view of secondary device disposed in the module of the steering assembly of FIG. 7, which is configured to receive energy inside the module in the non-rotating sleeve from a rotating part of the steering assembly that is rotationally decoupled from the non-rotating sleeve.

FIGS. 5 and 6 show an example of components that can be housed in the module 64. It is noted that the components are not limited to those shown in FIGS. 5 and 6, and are further not limited to the specific orientations, shaped and positions shown. Each component may be secured in any suitable manner. For example, the module 64 can include recesses shaped to conform to respective devices to be disposed therein. In one embodiment, the devices may be encapsulated and secured in place via the upper housing component 72 and/or one or more panels. In another embodiment, the devices may be installed into the modules 64 via ports or open holes, such as between upper and lower housing components. The devices may also be disposed separately in sections 76.

In the example of FIGS. 5 and 6, the module 64 includes the biasing element 62, the antenna 68 and various devices for performing functions related to steering, communication, power supply, processing and others. Such devices may include power supply devices, power storage devices, data storage devices, biasing control devices, communication devices, and electronics such as one or more controllers/processors, or data storage devices. Examples of devices that can be housed in the module 64 are discussed below, however the module 64 and constituent devices are not so limited.

The module 64 may also include a control mechanism for operating the biasing element 62. Examples of the control mechanism include, a hydraulic pump and/or a hydraulically controlled actuator, and a motor, such as an electric motor.

In the example of FIGS. 5 and 6, the module 64 includes a biasing control assembly for controlling the biasing element 62 (e.g., a hydraulic piston assembly), which includes a pump, comprising a motor 80, such as an electric motor and a linear motion device 84 such as a spindle drive or ball screw drive. Optionally, a gear (not shown) might be included between the motor 80 and the linear motion device 84 to increase the efficiency of rotary movement of the motor 80 and the linear movement of the linear motion device 84. The linear motion device 84 is coupled to the biasing element 62 via, e.g., a hydraulic coupling 86 utilizing a working fluid such as a hydraulic oil. In addition, or alternatively, valves (not shown) may be controlled by a controller 88 to direct the working fluid to apply appropriate pressure to the biasing element 62 via the hydraulic coupling 86. Optionally, a linear variable differential transformer (LVDT) (not shown) may be included to monitor, confirm, and/or measure the movement and/or an amount of engagement of a biasing member. As noted above, the utilization of the non-rotating sleeve 60 in conjunction with the operation of the biasing elements 62 allows for operation of steering systems with relatively low power demand. For example, the module 64 features low power stationary (hydrostatic) hydraulics to decrease the overall power demand.

To control the force and position of the biasing element 62, the module 64 includes control electronics or controller 88 that may include a data storage device. Controller 88 controls operation of the biasing control assembly by controlling at least one of the pump, the motor 80, the linear motion device 84, and/or one or more valves (not separately labeled). The module 64 may include or be in communication with (e.g., via the antenna 68) one or more directional sensors to measure directional characteristics of the BHA 18 or parts of the BHA 18, such as the measurement tool 30, the steering assembly 50 and/or the drill bit 54. In one embodiment, the directional sensors are configured to detect or estimate the azimuthal direction, the toolface direction, or the inclination of the sleeve 60. Examples of directional sensors include bending sensors, accelerometers, gravimeters, magnetometers, and gyroscopic sensors.

Any other suitable sensors may be included in the module or in communication with the module that might benefit from a position close to the bit. Examples of such sensors include formation evaluation sensors such as but not limited to sensors to measure resistivity, gamma, density, caliper, and/or chemistry, or sensors to measure operational data, such as time, drilling fluid properties, temperature, pressure, vibration related data, e.g. acceleration, weight, such as weight-on-bit, torque, such as torque-on-bit, depth, rate of penetration, rotational velocity, bending, stress, strain, and/or any other type of sensor or device capable of providing information regarding a formation, borehole and/or operation.

Another component that can be included in the module 64 is a pressure compensation device such as a pressure compensator 90. The pressure compensator 90 in this example is encapsulated within the module 64, except for a surface that is movable or flexible and exposed to fluid pressure. The pressure compensator 90 may be utilized to provide reference pressure that may equal or be related to fluid pressure external of the module 64 and/or to provide compensation fluid volume. The reference pressure may be provided to the motion device 84 and/or motor 80 in order to create a pressure difference with respect to the reference pressure to direct the working fluid to apply appropriate pressure to the biasing element 62 via the hydraulic coupling 86. Alternatively, or in addition to, the compensation fluid volume may be utilized for compensating fluid-filled volume that varies in response to moving motion device 84 or motor 80.

In another embodiment, the motion device 84 and/or motor 80 are moving with respect to a mechanical barrier such as a mechanical shoulder that prevents the motion of the motion device 84 in at least one direction. In yet another embodiment, the compensation fluid volume may be taken from a confined volume of compressible fluid such as gas, e.g. air. Hence, if the motion device 84 and/or motor 80 are moving with respect to a mechanical barrier that prevents the motion in at least one direction, and the compensation fluid volume is taken from a confined volume of compressible fluid such as gas, e.g. air, the configuration may be operable without a pressure compensator 90.

A communication device for at least partially wireless communication may be enclosed in the module 64. The communication device includes the antenna 68 or other means for wireless transmitting/receiving information, such as an inductive coupling device, an electromagnetic coupling device, an electromagnetic resonant coupling device, an acoustic coupling device, etc., and electronics such as a communication controller 92 that may include a data storage device. In this example, the antenna 68 is disposed at or near an outer surface of the housing 70 so that the antenna 68 is located at or near the outer diameter of the module 64 when assembled. The antenna 68 may be a patch antenna, a loop antenna, a fractal antenna, a dipole antenna or any other suitable type of antenna.

The communication device can use any suitable protocol or medium for communication. For example, the communication device can use electromagnetic waves for data transmission (e.g., the electromagnetic waves selected from a frequency between about 500 Hz and about 100 GHz, for instance, electromagnetic waves selected from a frequency between about 100 kHz and about 30 GHz). In another example, the communication device can use acoustic modulation for data transmission (e.g., the acoustic waves selected from a frequency between 100 Hz and 100 kHz), or can use optical modulation for data transmission.

The communication device can communicate with, e.g., another section of the drill string or BHA, to one or more other modules on the sleeve 60, to one or more other modules in other downhole components 58 or to the disintegration device 54. For example, the communication device can communicate with one or more other modules 64 to coordinate operation of the biasing elements 62. In addition, the communication device can act as a relay, repeater, amplifier, or processing device to forward communication to another communication device.

The communication controller 92 is connected to the communication device to send and/or receive commands, data and other communications to and/or from other controllers. To estimate or even synchronize the relative rotary position between the drill string and the sleeve 60, a dedicated sensor such as a magnetometer (e.g., a fluxgate or a Hall sensor) or other means to detect momentary rotary positions can be included in module 64 (e.g., invariances of a permanent magnet of an energy transmitting/receiving device 96).

Components housed in the module 64 may be powered via an energy storage device 94, such as a battery, a capacitor, a supercapacitor, a fuel cell, and/or a rechargeable battery.

In addition to, or in place of, energy storage device 94, the module 64 may include the energy transmitting/receiving device 96 to provide power to control the steering direction and perform other functions. Using energy transmitting/receiving device 96, energy may be transmitted to and/or received from surface assembly 22 via conductors (not shown) extending along the drill string 12 to an energy storage device (also not shown), such as batteries, rechargeable batteries, capacitors, supercapacitors, or fuel cells, arranged within the rotating part of the BHA, or to energy converters that converts one energy form (e.g. vibration, fluid flow such as the flow of the drilling fluid, relative motion/rotation of parts, such as the relative motion between the drive shaft 52 and the non-rotating sleeve 60) into another energy form (e.g. electrical energy, chemical energy within a battery or any combination thereof). Commonly known energy converters used downhole are, for example, turbines converting fluid flow into rotation of mechanical parts, generators/dynamos to convert rotation of mechanical parts into electrical energy, charging devices to convert electric energy into chemical energy of batteries. If the energy is provided downhole for other reasons than to provide energy those energy converters are sometimes referred to as energy harvesting devices.

In one embodiment, the energy transmitting/receiving device 96 includes one or more coils (e.g. energy harvesting coils) that are enclosed within the module 64. The coils are positioned so that they are within a magnetic field generated by a magnetic device (or devices) mounted on the drive shaft 52 or at other suitable locations.

In one embodiment, the magnetic device includes one or more magnets 98 (FIG. 3), such as electromagnets (e.g. coils, such as coils wound around magnetic material) or permanent magnets or a combination of both, that are attached to and rotate with the drive shaft 52 or other rotating component, thereby generating an alternating magnetic field that is received by the coils of the energy transmitting/receiving device 96. Electromagnets may include one or more conductive coils on the rotating drive shaft 52. Current can be applied to the conductive coils to generate a magnetic field. The current that is applied to the conductive coils may be modulated to create a modulated magnetic field, which may be used for communication and/or which may allow energy transfer into the module even when the drive shaft 52 is not rotating (or there is at least no substantial relative rotation between the drive shaft 52 and the sleeve 60).

The energy transmitting/receiving device 96 described herein uses magnetic energy transmission through a separator into an encapsulated unit (e.g., the energy harvesting coils). The magnetic energy coupling is accomplished, in one embodiment, by generating and varying a primary magnetic field by the magnetic device, which is received by a secondary device. The secondary device can be one or more stationary coils mounted in an appropriate direction and position with respect to the time-varying or alternating magnetic field created by the magnetic device. In this way, mechanical energy is converted directly into electrical energy.

The energy transmitting/receiving device 96 may include an energy controller 100 that may include a data storage device, for controlling power supply to components in the module, and/or to control the charge and re-charge of the energy storage device 94. The energy controller 100 may include a rectifier to generate a DC current from the received electrical energy that will be provided to other electronics within the module 64 by the energy controller 100. The energy controller 100 can be a distinct controller, or can be configured to control multiple components in the module, such as the energy transmitting/receiving device 96, the communication device for wireless communication, such as antenna 68, and/or the biasing element 62. As such, one or more of the energy controller 100, the communication controller 92, and the controller 88 to control the biasing element 62 may be actually the same or distinct controlling devices or control circuits with various control functions as appropriate. That is, the scope of this disclosure is not limited as to where which control function is implemented.

In one embodiment, the secondary device includes another magnetic device disposed in the primary magnetic field. The secondary device can be configured to be rotated or otherwise moved by the primary magnetic field and/or generate a secondary magnetic field.

Figure 10:
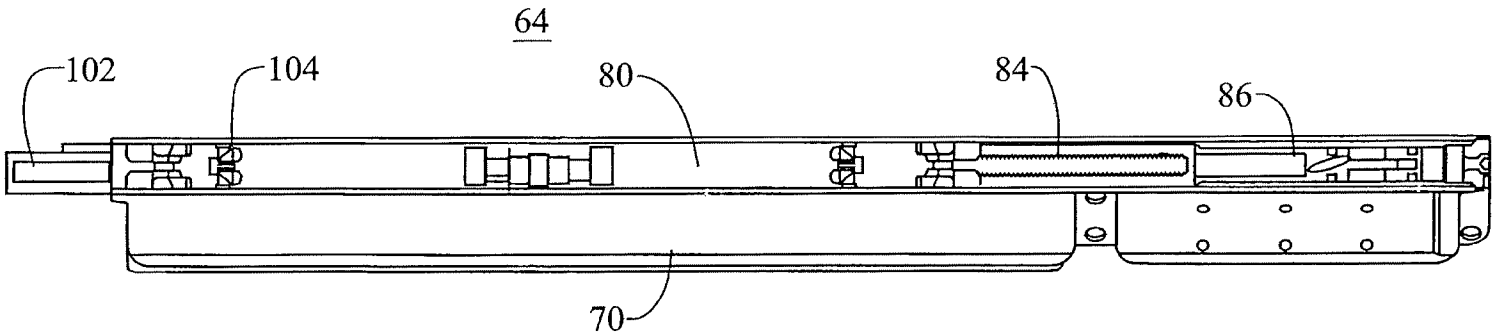
FIG. 10 is cross-sectional view of the module of the steering assembly of FIG. 9.

FIGS. 7-10 show an example of a secondary magnetic device configured to be positioned in the primary magnetic field. In this example, the secondary magnetic device includes a secondary shaft 102 disposed inside or connected to the module 64. The secondary shaft 102 is supported by bearings or another suitable mechanism so that the secondary shaft 102 is able to rotate independent of the sleeve and the module 64 as a response to the primary magnetic field created by the magnets 98 rotating with the drive shaft 52. The secondary shaft 102 can feature magnets, electrical coils or other devices attached to allow a torque transfer from the primary magnetic field to the secondary magnetic field. The secondary magnetic field can be created by, e.g., permanent magnets, eddy current devices, electrical coils and/or hysteresis materials. As shown in FIG. 10, the secondary shaft can be operably connected to an alternator device 104 to convert mechanical energy into electrical energy that can be provided to various components, e.g., to provide power to the motor 80 and/or charge an energy storage device. Optionally, a gear box (not shown), including a gear (also not shown), e.g. a planetary gear may be connected between the secondary shaft 102 and the alternator device 104 to achieve a more efficient energy transfer.

The modules described herein improve and facilitate the application of directional force (e.g., via biasing elements) to control the direction of a drilling assembly. In one embodiment, the modules are configured to house active biasing mechanisms, such as pistons, levers and pads that are actively controlled via a controller. In another embodiment, the biasing mechanisms can be supported by passive mechanisms such as springs, e.g., to engage the formation even in the event of a loss of the ability to actively control the biasing mechanisms. Both passive and active elements can be confined. For example, the biasing element 62 can be partially energized by springs. If the energy storage capacity of the energy storage device 94 turns out to be too small to provide communication and active formation engagement, the biasing element 62 can be energized by the springs exclusively or as an adjunct to an active biasing element.

Figure 11:
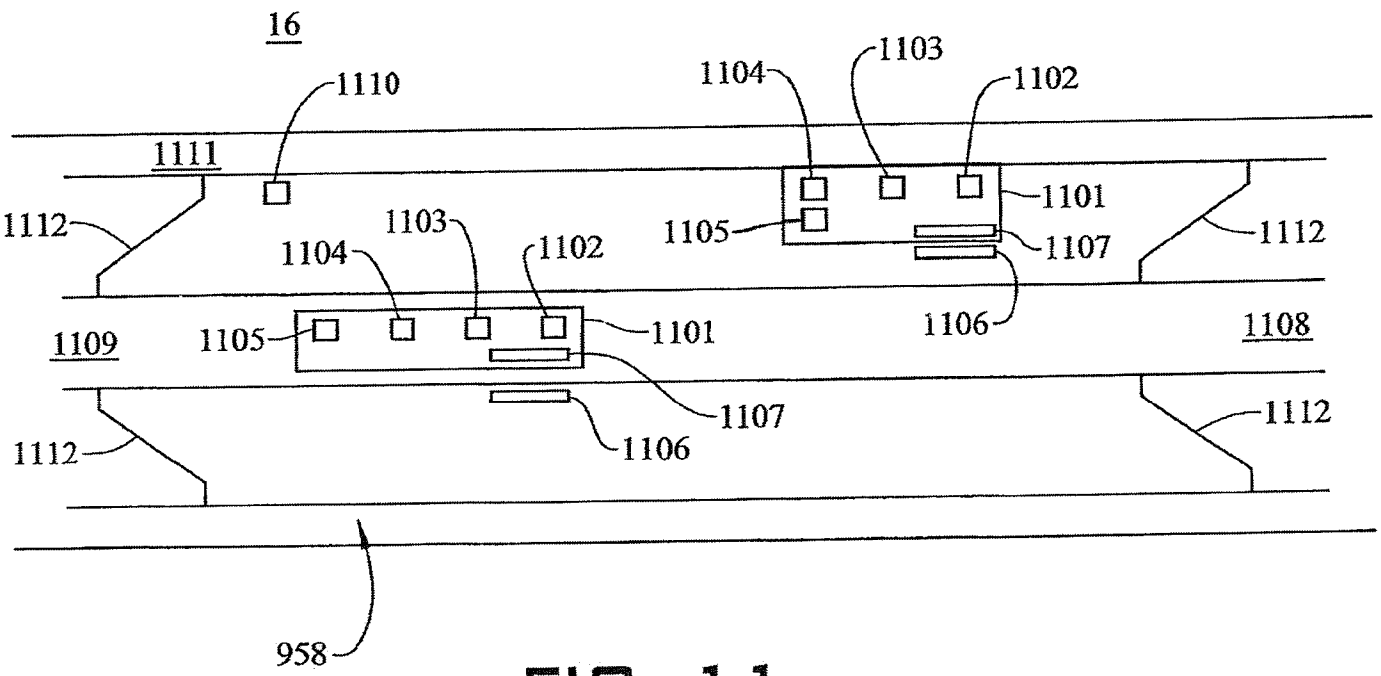
FIG. 11 depicts an embodiment of a downhole component which includes a sensor module, a communication device for wireless communication, an energy storage device, and an energy transmitting/receiving device.

FIG. 11 depicts a downhole component 958 in accordance with another aspect of an exemplary embodiment. Downhole component 958 may be part of the BHA 18, such as a measurement tool 30 or any other downhole component 958 that is operatively connected to the drill string 12 via a suitable string connection 1112 such as a pin-box connection. The downhole component 958 may comprise an inner bore 1109 where drilling fluid 1108, commonly referred to as mud, is flowing through to be supplied to downhole component 958 or other downhole components for lubrication, communication, cuttings removal, borehole stabilization, and/or cooling purposes.

The downhole component 958 has string connections 1112 at the upper and lower end similar to the bit box connection 56 in FIG. 2. Alternatively, downhole component 958 may include a standard downhole string connection, e.g. a standard pin-box string connection as shown in FIG. 11. Downhole component 958 may further comprise one or more modules 1101 comprising a sensor or probe 1102 for sensing a parameter of interest. The parameter of interest may be an operational parameter, such as but not limited to a direction (e.g., related to inclination, azimuth, or toolface) of at least a part of the BHA 18, one or more components of the earth's magnetic field, a gravity field, a rotational velocity, a rate of penetration, or a depth of the downhole component 958, a weight (e.g., related to weight-on-bit), a torque (e.g., related to torque-on-bit), a bending, a stress, or a strain of the downhole component 958, a cuttings parameter, such as an amount of cuttings, cutting density, cutting size, or a chemical composition of the cuttings, a vibration related parameter (e.g., related to acceleration), a mud property (e.g., related to a mud pressure, a mud temperature, a mud velocity, a sound speed of the mud, or a chemical component within the mud) of the mud that is present in bore 1109 or within an annulus 1111 between earth formation 16 and downhole component 958, or a formation parameter, such as but not limited to a pressure or a temperature parameter of earth formation 16 or a formation fluid, a nuclear parameter (e.g., related to natural gamma activity or neutron scattering of the earth formation 16), a density, permeability, or porosity of the earth formation 16, an electrical parameter (e.g., related to resistivity, conductivity, or permittivity) of the earth formation 16, an acoustic parameter of the earth formation 16 (e.g., related to sound speed or slowness or travel times of acoustic waves) and may include a sampling device such as a probe to take samples from the earth formation 16 (e.g. mud sample, formation fluid sample, core sample).

Accordingly, sensor 1102 may comprise one of a directional sensor (inclinometer, magnetometer, gravimeter, gyroscope), a sensor to determine rate of penetration downhole, a force, stress, strain, bending, or acceleration sensor to determine a force, a weight, a torque, a stress, a strain, bending and/or vibration, a pressure or a temperature sensor, a flow rate or fluid velocity sensor, a sound speed sensor, a sensor to determine chemical compositions (e.g. mass spectrometer, gas, fluid, or ion chromatograph), a sensor for nuclear radiation (e.g. alpha, beta, or gamma radiation), a nuclear magnetic resonance sensor, an electrical, magnetic, or electromagnetic sensor, an acoustic sensor, or any combination thereof.

The sensor 1102 may be single sensing element (e.g., a temperature probe) or at least a part of a transmitter-receiving sensor system comprising a transmitter that transmits a signal into the system that is to be measured (such as formation or mud) and a receiver that receives that signal after it is affected by the system that is to be measured wherein the received signal allows to derive one or more of the parameter of interest. The transmitting-receiving sensor system may be distributed over more than one module 1101 where at least one transmitter is disposed in one module 1101 and at least one receiver is disposed in another module similar to the module 1101 where the transmitter is located. Further, sensor 1102 may be part of a distributed sensor system with a plurality of discrete sensors or sensor systems disposed in a plurality of modules 1101 distributed along the drill string 12 in various downhole components 58.

Module 1101 may further comprise a communication device 1104 for wireless communication such as those discussed herein with respect to FIGS. 2-5. Communication device 1104 for wireless communication allows for communication from and/or to another communication device 1110 for wireless communication that may be located outside of module 1101. For example, the communication device 1110 may be located outside of module 1101 within the same downhole component 958 or a different downhole component within the BHA 18 that may be separated from the downhole component 958 by one or more string connections, such as string connections 1112. Alternatively, or in addition, communication device 1110 may be disposed in a second module that may be similar to module 1101. The communication device 1110 may be even included in a testing, verification, or calibration device external of downhole component 958 when module 1101 is disassembled from downhole component 958 for repair or maintenance purposes. The communication device 1104 allows to communicate data that is produced by a controller 1103 (that may include a data storage device) based on the sensing of sensor 1102 and/or to receive data from outside the module 1101 such as data comprising instructions, commands, or calibration data that may be processed by controller 1103 to operate the sensor 1102.

The module 1101 is mechanically and electrically self-contained and modular, in that the module 1101 can be attached to and removed from the downhole component 958 without affecting components in the module 1101 or downhole component 958. For example, each module 1101 includes mechanical attachment features such as clamping elements (not shown), e.g. devices for thermal clamping, devices including shape memory alloy, press fit devices, or tapered fit devices, or threads, or screw holes that allow the module 1101 to be fixedly connected to the downhole component 958 with a removable fixing mechanism such as screws, bolts, threads, magnets, or clamping elements, or any combination thereof. For example, module 1101 includes a housing (not separately labeled) that has a shape configured to be removably attached (e.g., via screws, bolts, threads, magnets, or clamping elements, e.g. mechanical clamping elements, thermal clamping elements, clamping elements including shape memory alloy, press fit elements, tapered fit elements, or any combination thereof) to a correspondingly shaped cutout (not separately labeled) in the wall of downhole component 958. For example, module 1101 may be fixedly connected to the downhole component 958 with removable fixing mechanism without any non-removable fixing elements.

In an embodiment, the module 1101 may be connected to the downhole component 958 by a connection that is not the string connection 1112. The module 1101 can therefore be handled as enclosed unit, even when it is detached from the downhole component 958. Thus, as the module 1101 may be a hermetically enclosed unit, it can, for instance, be tested, verified, calibrated, maintained, repaired, or it can exchange data (download or upload), without the need to attach the module 1101 to the downhole component 958, or simply be cleaned, e.g. by using a regular high pressure washer. The module 1101 may further be exchanged when not working properly to quickly repair the downhole component 958 during or in preparation of a drilling job.

In an embodiment, the module 1101 may be exchanged by accessing the BHA 18 or downhole component 958 from the outer periphery of the BHA 18 or downhole component 958. This allows to exchange the module 1101 without breaking string connections. In accordance with an exemplary aspect, module 1101 may be exchanged without disconnecting the string connections 1112 at the upper and/or lower end of the downhole component 958 in FIG. 11 and without disassembling the downhole component 958 from the BHA 18 or drill string 12. In further accordance with an exemplary aspect, module 1101 may be exchanged while the downhole component 58 is connected, e.g. mechanically connected to at least a part of the BHA 18 or drill string 12 via one or more string connections.

For example, module 1101 may be quickly exchanged from the outer periphery of downhole component 958 to repair the downhole component 958 while the downhole component 958 is still physically connected to the BHA 18 and/or drill string 12. Exchanged modules may be sent to an offsite repair and maintenance facility for further investigation and maintenance without the need to ship the downhole component 958 or to disconnect the string connections 1112 or 1102 of the downhole component 958 from the BHA 18 or drill string 12. That is, testing, verification, calibration, data transfer (download or upload), maintenance, and repair can be done on a module level rather than on a tool level. The capability for a quick exchange of modules to repair the downhole component 958 and the option to ship relatively small modules rather than complete downhole drilling tools and/or the capability for a quick exchange of modules to repair downhole components while the downhole component is still physically connected to the BHA 18 and/or drill string 12 is a major benefit in particular if more than one modules 1101 are disposed in downhole component 958 and helps to achieve a significant reduction in operational cost.

Still referring to FIG. 11, module 1101 may further comprise an energy storage device 1105 that is configured to store energy for the operation of one or more of the sensor 1102, the controller 1103, and the communication device 1104. Energy storage device 1105 may be rechargeable to allow for recharging the energy storage device 1105 during repair and maintenance cycles and/or during operation downhole of the downhole component 58. To that extent, module 1101 may further comprise an energy receiving device 1107 that wirelessly receives energy from an energy transmitting device 1106 outside of the module 1101. The energy that is transmitted by the energy transmitting device 1106 may be taken from the motion of the drilling fluid 1108 (e.g. by using a turbine) or mechanical parts within downhole component 958 or BHA 18, such as but not limited to the rotation of drill string 12 (e.g. by utilizing a non-rotating sleeves in combination with rotating magnets and inductive transformers, or inductive power devices as discussed above with respect to the energy transmitting/receiving device 96 in FIG. 5 in the non-rotating sleeve 60, or in combination with a mechanical coupling between rotating and non-rotating parts), or vibration of downhole components (e.g. by utilizing oscillating masses that are energized by vibration of the BHA 18).

Alternatively, the energy that is transmitted by the energy transmitting device 1106 may be provided from an energy source at the earth's surface via an electric connection along drill string 12, such as a wire, the electric connection connecting the downhole BHA 18 with surface assembly 22 at the earth's surface or downhole in the drill string 12 via an electric connection along drill string 12, such as a wire, the electric connection connecting the downhole BHA 18 with the downhole energy source. In yet another alternative embodiment, the energy that is transmitted by the energy transmitting device 1106 is provided by an energy storage device, such as a battery, a rechargeable battery, a capacitor, or a supercapacitor, or a fuel cell that is not included in the module 1101. The energy transmitting device 1106 may be disposed outside of module 1101 within the same downhole component 958 or a different downhole component within the BHA 18 that may be separated from the downhole component 958 by one or more string connections, such as string connections 1112.

The energy transmitting device 1106 may be even included in a testing, verification, calibration, repair, or maintenance device when module 1101 is disassembled from downhole component 958 for repair or maintenance purposes. Energy transmitting/receiving devices for wireless transmitting/receiving energy that can be used downhole are known in the art and may utilize inductive couplers, inductive power devices, inductive transformers, movable magnets, mechanical coupling, or magnetic coupling.

In an alternative embodiment, FIG. 11 illustrates downhole component 958 comprising one or more modules 1101' comprising a sensor or probe 1102' similar to sensor 1102 for sensing a parameter of interest. The difference of module 1101' and module 1101 is that module 1101' is disposed within a bore 1109 of downhole component 958 while module 1101 is disposed in a cavity or recess (not separately labeled) in the outer surface (also not separately labeled) of downhole component 958. For example module 1101' may be centralized in bore 1109 by using one or more centralizers (not shown). The parameter of interest sensed by sensor 1102' may be the same as or similar to those sensed by sensor 1102. As module 1101, module 1101' is mechanically and electrically self-contained and modular, in that the module 1101' can be attached to and removed from the downhole component 958 without affecting components in the module 1101' or downhole component 58.

Module 1101' may further comprise a communication device 1104', for wireless communication such as communication device 1104 of module 1101, a controller 1103' such as controller 1103 of module 1101 an energy storage device 1105' similar to energy storage device 1105 of module 1101, an energy receiving device 1107' that wirelessly receives energy from an energy transmitting device 1106' outside of the module 1101' similar to energy transmitting/receiving devices 1106/1107 of module 1101. Hence, by utilizing at least the sensor 1102' and the communication device 1104' for wireless communication, the module 1101' may be disposed without any physical electrical connection such as a wire, a connector or similar. This allows for a module that has no electrical connecting point such as an electrical outlet or inlet (e.g. plug, plug socket, receptacle, or similar). This may have great impact on the reliability of the module since electrical outlets or inlets are usually weak points of downhole parts in particular if it is required to seal the inside of the module from external fluids with high pressures that may occur in typical downhole environment.

The measurement apparatuses and antenna configurations described herein may be used in various methods for performing drilling operations. An example of a method includes controlling components of a steering system or sensor module including components disposed in a non-rotating sleeve module discussed herein. The method may be performed in conjunction with the system 10 and/or module(s) 64, 1101, 1101', but is not limited thereto. The method includes one or more stages described below. In one embodiment, the method includes the execution of all of the stages in the order described. However, certain stages may be omitted, stages may be added, or the order of the stages changed.

In a first stage, a drilling assembly connected to a drill string is deployed into a borehole, e.g., as part of a LWD or MWD operation. In a second stage, the drilling assembly is operated by rotating a drive shaft and a drill bit via a surface or downhole device. In one embodiment, the drive shaft is surrounded by a non-rotating sleeve that includes one or more modules that house and at least partially enclose one or more biasing elements. In another embodiment, one or more modules are included in the rotating parts of the BHA. One or more components in each module are powered via an energy storage device and/or energy transmitting/receiving device, such as a coil receiving an alternating magnetic field, an inductive coupler, inductive transformer, an inductive power device, movable magnets, mechanical coupling, or magnetic coupling that transforms mechanical energy from drilling fluid flow, rotation of the drive shaft, or vibration of the BHA to electrical energy that power control devices, sensors, and/or actuation devices for the biasing elements. In a third stage, communications between the module and other components of the drill string are performed. For example, the module communicates with another portion of the drill string such as a second module, an MWD tool or other downhole component, e.g. to provide communication to the surface, to communicate sensor data, such as drill string direction and position, or to coordinate operation of biasing elements. Each module can also communicate wirelessly to coordinate operation of multiple biasing elements or sensors in multiple modules.

In the fourth stage, the sensors or the biasing elements are operated to sense a parameter of interest, or to control and to steer the drilling assembly. For example, each module includes a controller that can receive communications or commands from a surface or downhole processing device (e.g., the surface processing unit, see FIG. 1) to actuate the biasing elements, e.g. to contact the borehole wall, or to control the sensing of a parameter of interest or the storing of data generated based on the sensed parameter of interest to a data storage device. The biasing elements that are operated to steer the drilling assembly or additional/alternative biasing elements (not shown) not operated to steer the drilling assembly (e.g. reamer blades or stabilizer blades of reamers or expandable stabilizers, respectively) may be initially expanded or actuated by active elements (e.g. actuators) or passive elements (e.g. springs) to increase friction between biasing elements and borehole wall.

For example, friction between biasing elements and the borehole wall might be increased up to a level that is close to or even higher than the friction of the bearing thereby creating an initial resistance of rotation of the sleeve with respect to the borehole wall and thus initiate a relative rotation between the drive shaft and the non-rotating sleeve. For example, the friction between biasing elements and borehole wall might be increased up to a level that allows for initial clamping between the borehole wall and the non-rotating sleeve and thus initiate a relative rotation between the drive shaft and the non-rotating sleeve.

Such biasing elements that are configured to be initially expanded or actuated to increase friction between non-rotating sleeve and borehole wall may be at least one of sliding pads, energized rollers, springs, blades, or rotating levers. Biasing elements that are configured to be initially expanded or actuated to increase friction between non-rotating sleeve and borehole wall may be active elements that require an external energy supply or passive elements that can be actuated or expanded without an external energy supply, such as, for example, springs. If initial expansion or actuation of the biasing elements is provided by active elements, the energy required to expand/actuate the biasing elements by the active elements may be provided by an energy storage device such as a capacitor, a supercapacitor, a battery, fuel cell, or a rechargeable battery. Such energy storage device may also be utilized to energize controllers or sensors within the module.

The initial higher friction caused by the initial actuation or expansion of the one or more biasing elements causes relative rotation of the drive shaft and the sleeve to allow for receiving energy by an energy receiving device that receives energy that is converted from the rotation energy of the drill string. The received energy is then used to operate biasing elements, controllers, electronics, sensors, or to charge the energy storage device. The energy storage device may also be re-loaded during operation of the steering assembly by the energy receiving device. One or more biasing elements are then operated to control the direction of the drilling assembly.

In the fifth stage, the drilling tool is removed from the borehole and the module including the biasing element, sensors, and/or electronics such as communication devices for wireless communication and/or energy transmitting/receiving devices for wirelessly transmitting and/or receiving energy is disassembled from the drilling assembly. The module will be shipped to a remote location for cleaning, verification, calibration, maintenance, data transfer (download or upload), or repair. During these activities, the communication device for wireless communication, the energy storage device, and/or the energy transmitting/receiving device allow to at least partly operate the module, or to communicate with the module, wirelessly. For example, some or all of the steps during cleaning, verification, calibration, data transfer (download or upload), maintenance, or repair may be done without a physical connection, such as an electrical connector to the module. This allows for a module that has no electrical connecting point such as an electrical outlet or inlet (e.g. plug, plug socket, receptacle, or similar). This may have great impact on the reliability of the module since electrical outlets or inlets are usually weak points of downhole parts in particular if it is required to seal the inside of the module from external fluids with high pressures that may occur in typical downhole environment.

In the sixth stage, another module that is at least similar to the module that was disassembled from the drilling assembly during the fifth stage will be installed into the drilling assembly that is already prepared and ready to be deployed downhole by one or more of cleaning, verification, calibration, maintenance, data transfer (download or upload), or repair. Due to the modularity of the module, no further measure or procedure has to be utilized to ensure sealing of the module or other downhole parts during this step. Therefore, no seal handling is required at the rig site. This allows for shorter assembly durations and ultimately to a reduction in operational costs.

Embodiments described herein provide numerous advantages. Advantages of the embodiments include simplifying assembly, repair, maintenance, testing, verification, data transfer (download or upload), and calibration of a steering assembly or measurement tool by providing power and/or communication to modules comprising biasing elements or sensors without any physical electrical connector. For example, maintenance of the steering assembly is simplified by allowing modules to be removed and replaced without affecting other steering assembly or drill string components, without having to perform complex procedures to assemble and disassemble a sleeve of the steering assembly, without connecting and/or disconnecting modules by physical electrical connectors to or from the steering assembly and without necessarily requiring highly skilled personal. The modularity of the modules provides for relatively simple exchanges of modules and improves turn-around time. Other advantages include lower system complexity, higher reliability and lower life cycle costs, and shorter overall tool and/or sleeve length.

Set forth below are some embodiments of the foregoing disclosure:

Embodiment 1

A device for steering a drilling assembly including a sleeve configured to be disposed around a length of a drive shaft configured to be disposed in a borehole in an earth formation. The drive shaft is configured to be rotated. The sleeve is configured to be rotationally decoupled from the drive shaft. Two or more modules are configured to be removably connected to the sleeve. Each of the two or more modules at least partially encloses a biasing element configured to be actuated to control a direction of the drilling assembly. Each of the two or more modules at least partially encloses a communication device for wireless communication.

Embodiment 2

The device of any prior embodiment, wherein the communication device is configured to communicate with a system external of the device.

Embodiment 3

The device of any prior embodiment, wherein the communication device is configured to receive data, wherein at least one of the two or more modules further comprises a controller, the controller being operable to control at least one of an actuation force and an extension of the biasing element.

Embodiment 4

The device of any prior embodiment, wherein at least one of the two or more modules comprises a sensor, operable to generate data that is transmitted via the communication device.

Embodiment 5

The device of any prior embodiment, wherein the sensor is at least one of a directional sensor, a formation evaluation sensor, and a sensor to measure operational data.

Embodiment 6

The device of any prior embodiment, wherein the two or more modules are removably connected to the sleeve by at least one of a screw, a bolt, a thread, a magnet, and a clamping device.

Embodiment 7

The device of any prior embodiment, wherein at least one of the two or more modules includes the clamping device comprising at least one of a mechanical clamping device, a thermal clamping device, a shape memory alloy, a press fit device, and a tapered fit device.

Embodiment 8

The device of any prior embodiment, further including an energy storage device disposed in at least one of the two or more modules, the energy storage device being operable to provide energy to the communication device and the biasing element.

Embodiment 9

The device of any prior embodiment, wherein each of the two or more modules is sealed.

Embodiment 10

The device of any prior embodiment, wherein the communication device comprises at least one of an antenna, an inductive coupling device, an electromagnetic coupling device, an electromagnetic resonant coupling device, and an acoustic coupling device.

Embodiment 11

The device of any prior embodiment, further including an energy transmitting device and an energy receiving device, the energy receiving device disposed in at least one of the two or more modules, wherein the energy transmitting device transmits energy at least partially wirelessly to the energy receiving device.

Embodiment 12

The device of any prior embodiment, further including an energy storage device disposed in at least one of the two or more modules, the energy storage device being configured to store energy that is received by the energy receiving device.

Embodiment 13

The device of any prior embodiment, wherein the energy transmitting device comprises at least one of an antenna, an inductive transformer, a permanent magnet, an electromagnet, and a coil.

Embodiment 14

The device of any prior embodiment, wherein at least of one of the energy transmitting device and the energy receiving device further includes an alternator device operable to convert mechanical energy to electrical energy.

Embodiment 15

The device of any prior embodiment, wherein the biasing element is configured to exert a force against a borehole wall to initiate rotation of the drive shaft relative to the sleeve.

Embodiment 16

A method of steering a drilling assembly includes disposing the drilling assembly in an earth formation. The drilling assembly includes a sleeve configured to be disposed around a length of a drive shaft. The sleeve is configured to be rotationally decoupled from the drive shaft. Two or more modules are removably connected to the sleeve. Each of the two or more modules at least partially encloses a biasing element and a communication device for wireless communication. The method further includes communicating, with the communication device at each of the two or more modules, and actuating the biasing element in at least one of the two or more modules to control a direction of the drilling assembly.

Embodiment 17

The method of any prior embodiment, further including sensing with a sensor in at least one of the two or more modules a property, and at least partially wirelessly communicating with the communication device data that is generated based on the property to a device that is external to the at least one of the two or more modules.

Embodiment 18

The method of any prior embodiment, further including providing, at least partially wirelessly, energy to at least one of the two or more modules by an energy transmitting device and an energy receiving device, the energy receiving device disposed in the one of the two or more modules.

Embodiment 19

The method of any prior embodiment, wherein communicating with the communication device includes modulating the energy provided by the energy transmitting device.

Embodiment 20

The method of any prior embodiment, wherein removably connecting the two or more modules includes operatively engaging with at least one of a screw, a bolt, a thread, a magnet, and a clamping device.

In connection with the teachings herein, various analyses and/or analytical components may be used, including digital and/or analog subsystems. The system may have components such as a processor, storage media, memory, input, output, communications link (wired, wireless, pulsed mud, optical or other), user interfaces, software programs, signal processors and other such components (such as resistors, capacitors, inductors, etc.) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user, or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. A device for steering a drilling assembly, comprising:

a sleeve configured to be disposed around a length of a drive shaft configured to be disposed in a borehole in an earth formation, the drive shaft configured to be rotated, the sleeve is configured to be rotationally decoupled from the drive shaft; and two or more modules configured to be removably connected to the sleeve, each of the two or more modules at least partially enclosing a biasing element configured to be actuated to control a direction of the drilling assembly, each of the two or more modules at least partially enclosing a communication device having an antenna for wireless communication, wherein the antenna in at least one of the two or more modules is configured to receive signals that are transmitted by the antenna of the communication device in the other of the two or more modules to coordinate activation of biasing elements on each of the two or more modules to steer the drilling assembly.

2. The device of claim 1, wherein the communication device is configured to communicate with a system external of the device.

3. The device of claim 1, wherein the communication device is configured to receive data, wherein the at least one of the two or more modules further comprises a controller, the controller being operable to control at least one of an actuation force and an extension of the biasing element.

4. The device of claim 1, wherein the at least one of the two or more modules comprises a sensor, operable to generate data that is transmitted via the communication device.

5. The device of claim 4, wherein the sensor is at least one of a directional sensor, a formation evaluation sensor, and a sensor to measure operational data.

6. The device of claim 1, wherein the two or more modules are removably connected to the sleeve by at least one of a screw, a bolt, a thread, a magnet, and a clamping device.

7. The device of claim 6, wherein the at least one of the two or more modules includes the clamping device comprising at least one of a mechanical clamping device, a thermal clamping device, a shape memory alloy, a press fit device, and a tapered fit device.

8. The device of claim 1, further comprising: an energy storage device disposed in the at least one of the two or more modules, the energy storage device being operable to provide energy to the communication device and the biasing element.

9. The device of claim 1, wherein each of the two or more modules is sealed.

10. A device for steering a drilling assembly, comprising:

a sleeve configured to be disposed around a length of a drive shaft configured to be disposed in a borehole in an earth formation, the drive shaft configured to be rotated, the sleeve configured to be rotationally decoupled from the drive shaft;

two or more modules configured to be removably connected to the sleeve, each of the two or more modules at least partially enclosing a biasing element configured to be actuated to control a direction of the drilling assembly, each of the two or more modules at least partially enclosing a communication device for wireless communication; and an energy transmitting device and an energy receiving device, the energy receiving device disposed in at least one of the two or more modules, wherein the energy transmitting device transmits energy at least partially wirelessly to the energy receiving device.

11. The device of claim 10, further comprising an energy storage device disposed in the at least one of the two or more modules, the energy storage device being configured to store the energy that is transmitted by the energy transmitting device.

12. The device of claim 10, wherein the energy transmitting device comprises at least one of an antenna, an inductive transformer, a permanent magnet, an electromagnet, and a coil.

13. The device of claim 10, wherein at least of one of the energy transmitting device and the energy receiving device further includes an alternator device operable to convert mechanical energy to electrical energy.

14. The device of claim 10, wherein the biasing element is configured to exert a force against a borehole wall to initiate rotation of the drive shaft relative to the sleeve.

15. A method of steering a drilling assembly, comprising:

disposing the drilling assembly in an earth formation, the drilling assembly including a sleeve configured to be disposed around a length of a drive shaft, the sleeve configured to be rotationally decoupled from the drive shaft;

removably connecting two or more modules to the sleeve, each of the two or more modules at least partially enclosing a biasing element and a communication device having an antenna for wireless communication;

transmitting signals through the antenna at the commination device of at least one of the two or more modules to another communication device at another of the two or more modules;

receiving the signals transmitted by the antenna of the communication device at the at least one of the two or more modules at an antenna of the another communication device of the another of the two or more modules to coordinate activation of biasing elements on each of the two or more modules; and actuating the biasing elements to control a direction of the drilling assembly.

16. The method of claim 15, further comprising: sensing with a sensor in the at least one of the two or more modules a property, and at least partially wirelessly communicating with the communication device data that is generated based on the property to a device that is external to the at least one of the two or more modules.

17. The method of claim 15, wherein removably connecting the two or more modules includes operatively engaging with at least one of a screw, a bolt, a thread, a magnet, and a clamping device.

18. A method of steering a drilling assembly, comprising:

disposing the drilling assembly in a borehole in an earth formation, the drilling assembly including a sleeve configured to be disposed around a length of a drive shaft, the sleeve configured to be rotationally decoupled from the drive shaft;

removably connecting two or more modules to the sleeve, each of the two or more modules at least partially enclosing a biasing element engaged with a wall of the borehole and a communication device for wireless communication;

communicating, with the communication device at each of the two or more modules;

actuating the biasing element in at least one of the two or more modules to control a direction of the drilling assembly; and providing, at least partially wirelessly, energy to the at least one of the two or more modules by an energy transmitting device and an energy receiving device, the energy receiving device disposed in the at least one of the two or more modules.

19. The method of claim 18, wherein communicating with the communication device includes modulating the energy provided by the energy transmitting device.

* * * * *